US005803175A

United States Patent [19]

Myers, Jr. et al.

[11] Patent Number: 5,803,175

[45] Date of Patent: Sep. 8, 1998

[54] PERFORATING GUN CONNECTION AND METHOD OF CONNECTING FOR LIVE WELL DEPLOYMENT

[76] Inventors: William Desmond Myers, Jr., 18034 Bambriar Dr., Houston, Tex. 77090; Robert R. Green, 2815 Kismet, Houston, Tex. 77043

[21] Appl. No.: 633,916

[22] Filed: Apr. 17, 1996

[51] Int. Cl.[6] ..... E21B 43/119; E21B 17/046

[52] U.S. Cl. ..... 166/297; 166/242.6; 166/378; 166/70

[58] Field of Search ..... 166/70, 55.1, 297, 166/378, 379, 380, 381, 242.6, 242.7; 175/4.52, 4.56

[56] References Cited

U.S. PATENT DOCUMENTS

| | | |
|---|---|---|
| Re. 25,471 | 11/1963 | Fredd . |
| 4,116,272 | 9/1978 | Barrington . |
| 4,253,525 | 3/1981 | Young . |
| 4,273,186 | 6/1981 | Pearce et al. . |
| 4,311,197 | 1/1982 | Hushbeck . |
| 4,368,871 | 1/1983 | Young . |
| 4,378,850 | 4/1983 | Barrington . |
| 4,415,036 | 11/1983 | Carmody et al. . |
| 4,427,071 | 1/1984 | Carmody . |
| 4,444,268 | 4/1984 | Barrington . |
| 4,448,254 | 5/1984 | Barrington . |
| 4,476,933 | 10/1984 | Brooks . |
| 4,522,370 | 6/1985 | Noack et al. . |
| 4,531,587 | 7/1985 | Fineberg . |
| 4,579,174 | 4/1986 | Barrington . |
| 4,595,060 | 6/1986 | Beck . |
| 4,603,742 | 8/1986 | Wong et al. . |
| 4,618,000 | 10/1986 | Burris, II . |
| 4,619,325 | 10/1986 | Zunkel . |
| 4,624,317 | 11/1986 | Barrington . |
| 4,655,288 | 4/1987 | Burris, II et al. . |
| 4,665,991 | 5/1987 | Manke . |
| 4,711,305 | 12/1987 | Riggenberg . |
| 4,825,902 | 5/1989 | Helms . |
| 4,846,281 | 7/1989 | Clary et al. . |
| 4,856,558 | 8/1989 | Kardos . |
| 4,903,775 | 2/1990 | Manke . |
| 4,986,358 | 1/1991 | Lueders et al. . |
| 5,159,949 | 11/1992 | Prescott et al. . |
| 5,201,371 | 4/1993 | Allen . |
| 5,203,410 | 4/1993 | Cobb et al. . |

(List continued on next page.)

FOREIGN PATENT DOCUMENTS

WO 97/27832 7/1997 WIPO .

OTHER PUBLICATIONS

Sas–Jaworsky II, et al., Coiled tubing 1995 update: Production applications, *World Oil,* Jun. 1995, 97–105.

Tim Walker, et al., *Downhole Swab Valve Aids in Underbalanced Completion of North Sea Well,* SPE 30421, Society of Petroleum Engineers, Inc., 1995, 3 pages.

Tim Walker, et al., *Underbalanced Completions Improve Well Saftey and Productivity,* World Oil, Nov. 1995, 4 pages.

*Primary Examiner*—David J. Bagnell

*Attorney, Agent, or Firm*—Rosenblatt & Redano P.C.

[57] ABSTRACT

A connector is presented for tubing conveyed perforating guns which facilitates connection or disconnection between guns without the need for rotation. A latching mechanism is disclosed which latches by setting down weight and unlatches by an actuating ram camming the latch out of a window. The connectors are configured so that they are sealed internally and have an external profile for interengagement with a seal ram for support and sealing around the outer periphery. Accordingly, a live well can be isolated using a seal ram around a fired gun because the internal passages through the gun are sealed off by virtue of seals around a hammer piston. The connectors are configured so that an upper gun creates the pressure required to set off the gun below. The connectors are also configured such that when a lower gun is supported by a seal ram, an emergency shear zone is presented opposite a shear ram to ensure that if an emergency well shutdown is required that the shear ram does not have to cut through a section of the gun which contains explosives.

47 Claims, 4 Drawing Sheets

U.S. PATENT DOCUMENTS

| | | | |
|---|---|---|---|
| 5,213,125 | 5/1993 | Leu . | |
| 5,366,014 | 11/1994 | George | 166/297 |
| 5,411,096 | 5/1995 | Akkerman . | |
| 5,465,786 | 11/1995 | Akkerman . | |
| 5,503,224 | 4/1996 | Field | 166/242.6 X |
| 5,509,481 | 4/1996 | Huber et al. | 166/297 |
| 5,529,127 | 6/1996 | Burleson et al. | 166/380 |
| 5,603,379 | 2/1997 | Henke et al. | 166/297 |

PERFORATING GUN CONNECTION AND METHOD OF CONNECTING FOR LIVE WELL DEPLOYMENT

FIELD OF THE INVENTION

The field of this invention relates to techniques for insertion and removal of perforating guns, particularly tubing conveyed perforating guns.

BACKGROUND OF THE INVENTION

Perforating guns have traditionally been used to stimulate production from a formation once the well has been drilled. Perforating guns have also been used in existing wells previously on production from a particular zone to initiate production from other zones within the wellbore.

If the well is pressurized, one technique that has been used to facilitate perforation at a given depth is to kill the well with heavy fluids prior to the perforating procedure. However, the technique of killing the well is thought to be undesirable in that it may adversely affect the future performance of the well from the zone to be perforated. The alternative to killing the well is to run the perforating guns into the wellbore in a live condition. To do this requires an assembly of rams and blowout preventers used in conjunction with an elongated housing that facilitates insertion and removal of downhole tools in the wellbore, as well as the tubing, commonly known as a lubricator.

Sometimes the string of guns can be quite lengthy, well in excess of the general length of a lubricator which is approximately 60 feet. The guns themselves are generally in the order of about 15 feet long and are stacked above the other and spaced accordingly so that when they are spotted below, the perforation will occur at the proper locations and intervals. One of the concerns that has arisen in the past was stacking perforating guns and inserting them through a lubricator is the connections that have been available. In the past, some sort of rotation has generally been required to connect one gun to the other when putting them in a string of guns. This has created complexities required of the lubricator, as well as various hydraulic supplies, which have been required to be connected to the lubricator to initiate the required rotation to connect one gun to the other while in the lubricator. Accordingly, one of the objectives of the present invention is to present a connection technique which requires no rotation and can be easily accomplished by merely setting down weight. With this objective accomplished, the lubricator employed can be far simpler and it can be set up quicker, but most importantly the integrity of the joints is far greater when the uncertainties of combined movements are removed for connection of one gun to another.

Another problem that can arise in trying to remove guns after firing from a live well is the potential for leak paths through the fired guns internally thereof. Thus, another object of the invention is to provide connectors which will allow for reliable external sealing around the fired guns for the removal process, while, at the same time, sealing off any internal leak paths, thus allowing for effective well control during the removal operation. The configuration of the connectors is also such that when properly supported by a hanging and seal ram (hereinafter "seal ram"), a section of the connector is presented opposite a shear ram where that section has no explosives. Accordingly, another object of the invention is to present a zone of the connector opposite the shear ram so that if an emergency situation develops, the shear ram does not need to cut through a zone having explosives which could create an extremely dangerous situation at the surface. Yet another objective of the present invention is to provide for easy connection and disconnection between perforating guns. Those and other objectives of the invention will become more apparent after review of the detailed description of the preferred embodiment below.

SUMMARY OF THE INVENTION

A connector is presented for tubing conveyed perforating guns which facilitates connection or disconnection between guns without the need for rotation. A latching mechanism is disclosed which latches by setting down weight and unlatches by an actuating ram camming the latch out of a window. The connectors are configured so that they are sealed internally and have an external profile for interengagement with a seal ram for support and sealing around the outer periphery. Accordingly, a live well can be isolated using a seal ram around a fired gun because the internal passages through the gun are sealed off by virtue of seals around a hammer piston. The connectors are configured so that an upper gun creates the pressure required to set off the gun below. The connectors are also configured such that when a lower gun is supported by a seal ram, an emergency shear zone is presented opposite a shear ram to ensure that if an emergency well shutdown is required that the shear ram does not have to cut through a section of the gun which contains explosives.

BRIEF DESCRIPTION OF THE DRAWINGS

FIG. 1 is an assembly view in section of a lower gun and an upper gun with the connector in between.

DETAILED DESCRIPTION OF THE PREFERRED EMBODIMENT

Figure 1:
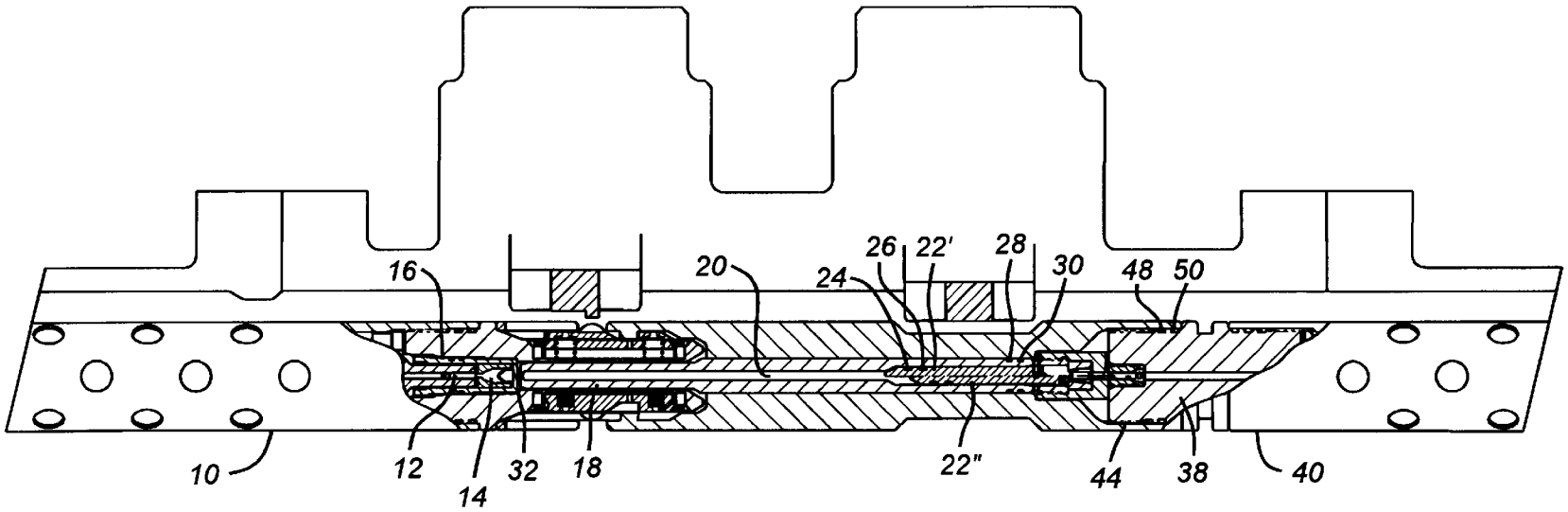

The invention is best understood by looking at the overall assembly in FIG. 4 which illustrates a series of components inside a lubricator L, which is represented schematically. FIG. 4 also shows the overall layout of the lubricator L. FIG. 3 and FIG. 1 show an upper gun assembly 10 includes a booster 12 and a shaped charge 14. The shaped charge is in a housing 16 which is abutting housing 18. Within hammer piston housing 18 is a passage 20 which communicates to hammer piston 22. Hammer piston 22 is shown in split view. In the position 22', the hammer piston 22 is in the pre-firing position, and in the position indicated by 22", it is in the fired position. The hammer piston 22 has seals 24 and 26 at its upper end, and seals 28 and 30 at the lower end housing of 18. Seals 24–30 seal around the hammer piston 22 and its housing 18 in passage 32, which extends through emergency shear zone 34 (see FIG. 4). Seals 31 and 33 are mounted to housing 16 to seal between housing 16 and passage 32. The details are more readily observable in FIG. 2. Below hammer piston 22 is percussion initiator 36. Below the percussion initiator 36 is the connector sub 38 of lower gun 40. Those skilled in the art will appreciate that movement of hammer piston 22 initiates the percussion initiator 36 which, in turn, fires gun 40 through connector sub 38. The connector sub 38 is secured at thread 44 to body 46 of the connector C. Seals 48 and 50 seal the connection formed by thread 44.

Figure 2:
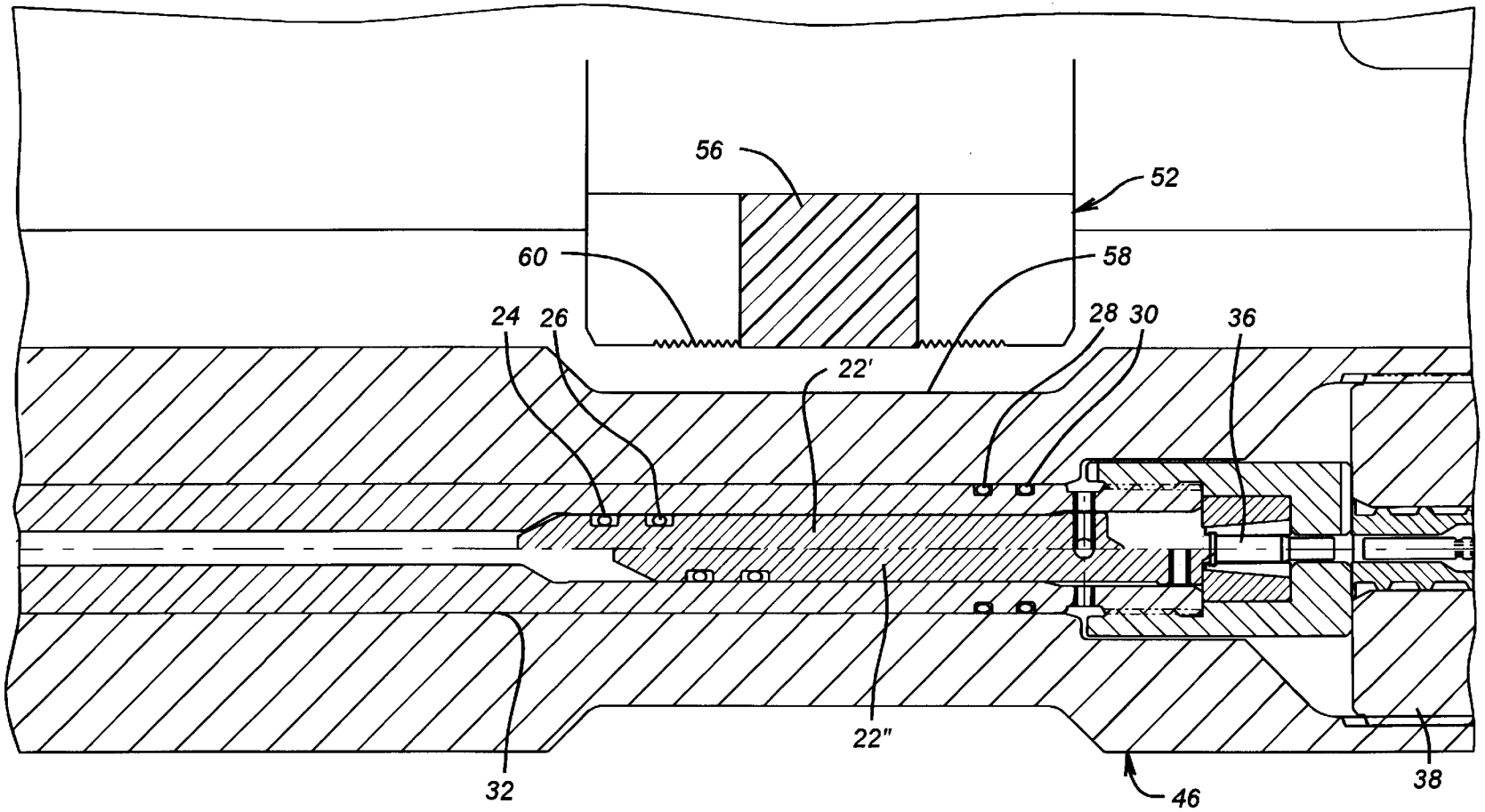
FIG. 2 is a detail of the connector, shown in FIG. 1, illustrating the hammer piston in split view with the seal ram supporting the lower gun.
Figure 3:
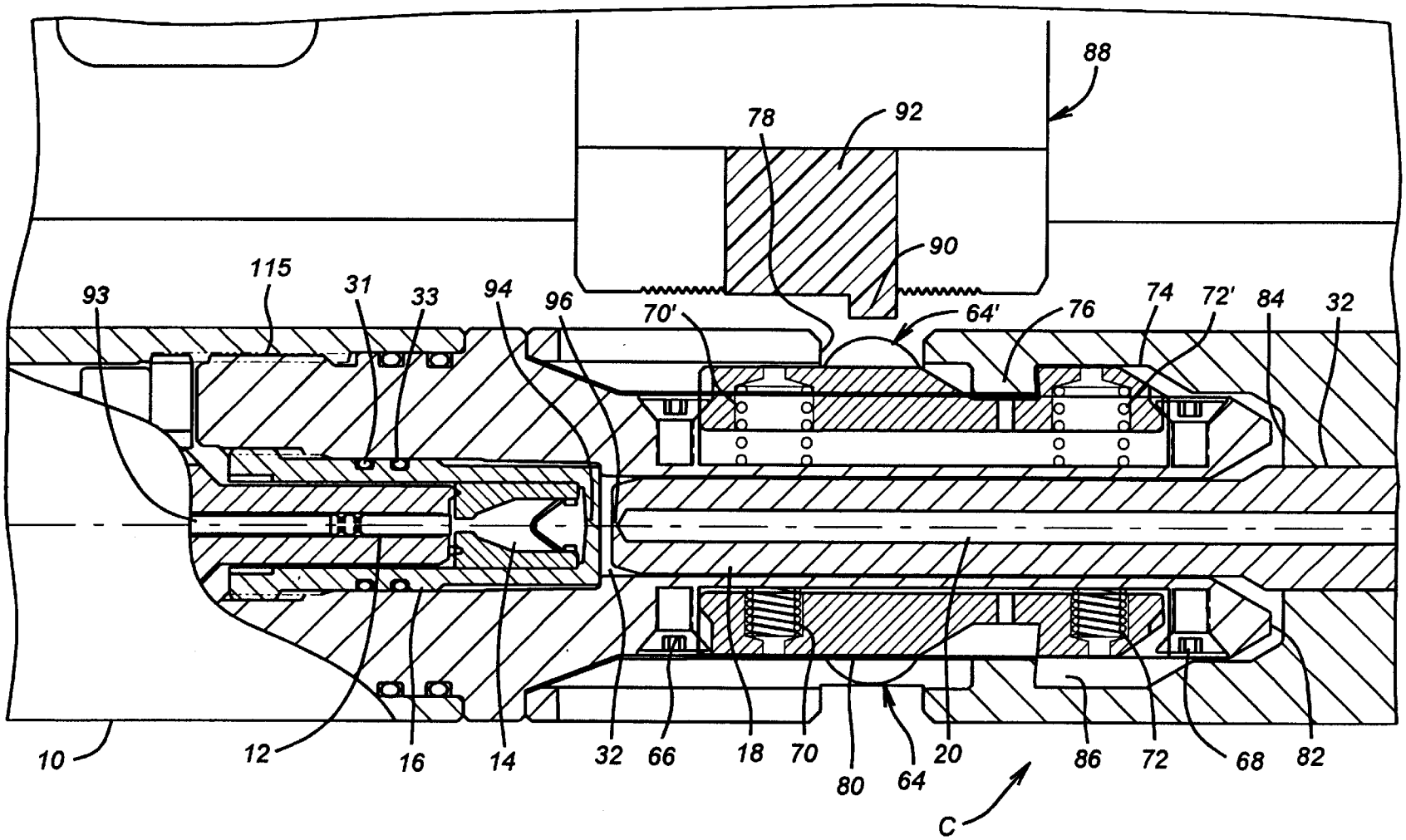
FIG. 3 is a detail of the assembly, shown in FIG. 1, illustrating in more detail the latch assembly in the latched position.
Figure 4A:
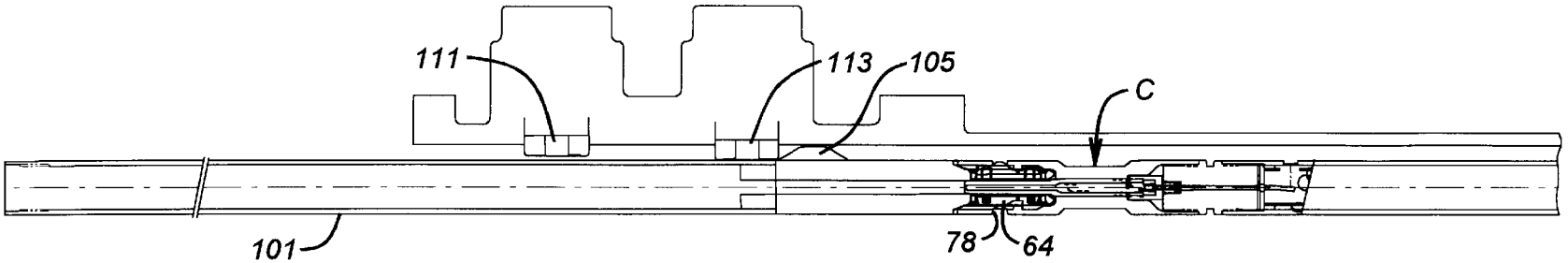
FIG. 4*a*–4*c* is a layout of an assembly of guns in a lubricator showing the configuration of the rams and the guns within the lubricator in section view.
Figure 4B:
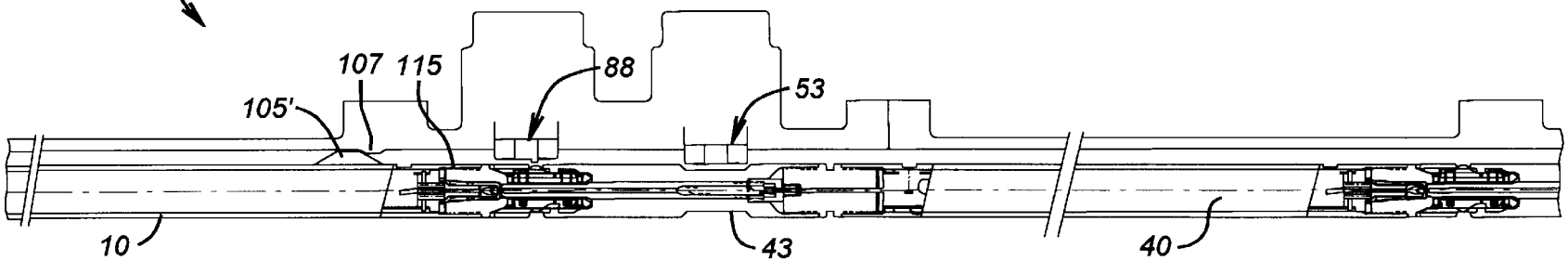
Figure 4C:
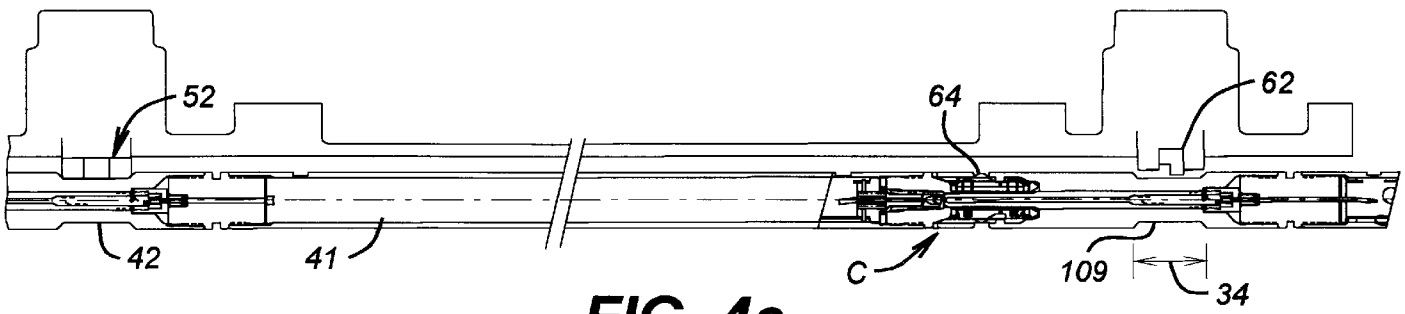

The lubricator L has several seal rams 52 and 53 designed to engage the recesses 42 and 43 when the seal rams 52 and 53 are engaged, as shown in FIGS. 2 and 4. The seal ram, such as 52, has a sealing element 56 which engages all around surface 58 effectively sealing around the exterior of the lower gun 40. The seal ram 52 has a serrated gripping surface 60 to better secure the position of the lower gun 40. Illustrated schematically in FIG. 4 is shear ram 62 which is supported by the lubricator L and is alignment with emergency shear zone (arrow 34) formed by recess 42 on the body 46. Accordingly, when the lower gun 40 is engaged, as shown in FIG. 2, by the seal ram 52, the shear ram 62 is in position to cut through body 46 in the approximate location of hammer piston 22 of another gun 41 below gun 40 (see FIGS. 4*b*–4*c*). It should be noted that there are no explosives in the emergency shear zone defined by arrow 34. Accordingly, if an emergency shutdown of the well is required, the shear ram 62 can be actuated without concerns that it will aggravate the problem by having to penetrate an explosive charge.

The details of the latching of one gun to another through the connector C is best seen in FIG. 3. The upper gun assembly 10 has a series of dogs 64 which are retained respectively at the upper and lower ends by retainers 66 and 68. The dogs are spring-biased outwardly by springs 70 and 72. It should be noted that FIG. 3 is again a split view with the lower portion indicating the dogs 64 in the retracted position with springs 70 and 72 compressed. On the top portion of the drawings, the dogs 64' are in an expanded position with springs 70' and 72' in a more relaxed or expanded position. The connector C which has a body 46 has an internal groove 74 adjacent an inwardly oriented projection 76 and followed by a window 78. Dogs 64 have a projection 80 which, when aligned with window 78, can facilitate the outward movement of the dogs 64 into the latching position shown in FIG. 3. Those skilled in the art will appreciate that with the lower gun 40, which is shown in FIG. 4, firmly supported by ram 52 that setting down weight on the upper gun assembly 10 advances the nose 82 into the receptacle 84 of body 46 on connector C. Initially, the dogs 64 are pushed radially inwardly to allow projection 86 on dogs 64 to pass beyond projection 76 on connector C. Once the dogs 64 have been cammed inwardly by projection 76, they can then spring out behind projection 76 into internal groove 74. Thus, when projection 86 on dogs 64 extends into groove 74, it is held there by the springs 70' and 72', while, at the same time, the projection 80 is in window 78. This latching procedure is accomplished exclusively with setting down weight on the upper gun assembly 10. When it is time to disengage, the procedure is reversed with the assistance of actuating ram 88. Actuating ram 88 has a projection 90 on a release element 92. When it is time to disengage, the actuating ram 88 is advanced toward projection 80 until it contacts projection 80 and squeezes springs 70' and 72' to get them in the position shown for springs 70 and 72 at the lower portion of FIG. 3. With the dogs 64, as shown in the lower portion of FIG. 3 and projection 80 out of window 78, an upward pull on upper gun assembly 10 results in a release at the connector C. Again, release is accomplished with a combined actuation of the actuating ram 88 coupled with an upward pull on the upper gun assembly 10.

Those skilled in the art will appreciate that a known firing head is connected at the top of the string of guns and ultimately in communication with cord 93 to initiate the shaped charge 14 to fire the lower gun assembly 40. The lower gun assembly 40 can comprise a plurality of guns (see guns 40 and 41 in FIG. 4), each of which is connected by a connector C with a similar assembly, as depicted, such that actuation of hammer piston 22 fires off the top-most lower gun assembly 40, which, in turn, i.e., gun 41, by virtue of another shaped charge to fire gun 41, thus allowing all the guns to be fired in sequence from the upper-most to the lower-most gun. At the top of each gun is a hammer piston assembly 22, which includes seals 24 and 26 so that, despite the fact that the guns can be fired in series, after firing, the internal of each gun is sealed off to its hammer body 18 to prevent the creation of a flowpath therethrough.

Another feature that provides flexibility to the system is that if for any reason the seals 24–30 in a given hammer piston assembly 22 or hammer body 18 fail, the next gun in sequence will hopefully have functional seals comparable to seals 24–30 on its hammer piston assembly 22 and hammer body 18 such that leakage through the body of a particular gun will be a very modest amount as the seals internally in the gun below will stop any further flow from the wellbore.

Additionally, if for any reason the seal ram 53 fails to obtain an adequate seal around surface 58 of the connector C, the lubricator L is of sufficient length so that the next lower seal ram 52 can do the same job. Other rams in the lubricator L can be operated prior to relying on a last resort, which is using the shear ram 62.

The advantages of the present invention should now be apparent. The connector C facilitates engagement between guns using set down weight only. Disengagement is accomplished using actuating ram 88 to push dogs 64 out of engagement with the connector C. Another advantage is that internally the guns that are connected in this manner can be fired in sequence and after firing there is no internal fluid passage for the fluids in a well under pressure to flow through as the guns are being removed. Through the use of sealed hammer pistons 22, the sequential firing of guns can be accomplished while the communication between guns through the connector C is eliminated. However, even in the event of failure of internal seals, such as 24 and 26, on a hammer piston 22, only a limited volume must be purged through the lubricator L if the comparable seals around a hammer piston 22 that is further down in the hole are holding. In the event of a failure to obtain an external seal around a given gun using the seal ram 53, the length of the lubricator is such that the next seal ram 52 in sequence can be actuated to determine if an external seal can be obtained in that manner on the next gun down. If that is not workable and all other available seal rams don't hold well pressure, then use is made of shear ram 62. At this time, with the guns in position, as shown in FIG. 4, the shear ram 62 is already in position opposite the emergency shear zone indicated by arrow 34 so that the shear ram 62 can be actuated to shut in the well completely. It will not cut through a zone that houses any explosives. This occurs because with a given gun supported by the seal ram 52, the orientation of the connector C is such that a portion of the housing hammer piston 22 is oriented adjacent the shear ram 62. Thus, the present invention by providing the internal sealing capability for the guns in the string facilitates the safe removal of the guns through a lubricator in a live well situation. The ease of connecting and disconnecting simply by pull or push forces without rotation further provides a more secure make-up and allows for faster rig up with more economical lubricators which are simpler since the lubricators envisioned in the present invention do not need a feature to initiate rotation.

Those skilled in the art will appreciate that the latching procedure can be accomplished with the actuating ram 88 in the extended position where projection 90 extends into window 78.

Those skilled in the art will appreciate that when the shaped charge 14 is set off, it penetrates through walls 94 and 96 to open up communication to passage 20. Accordingly, in the fired position, walls 94 and 96 will have been blown out of the way to allow pressure communication to the hammer piston 22 to set off the initiator 36 and fire the next gun below. Seals 24, 26, 28, and 30 retain the pressure to allow hammer piston 22 to move. Accordingly, a system of connector C is illustrated with internal sealing mechanisms around the hammer piston 22, which allows a series of guns to be fired with the internal passageways therethrough, being retained in a sealing condition. Removal is thus made far safer in a live well situation.

FIG. 4 illustrates how the string of guns can be inserted and removed from the wellbore. A key to the insertion or removal of the guns is a running tool 101 which is configured to have a series of dogs, such as 64, so that it can slip in and be attached to any given gun that has a connector C. Illustrated in FIG. 4 are four guns 10, 40, 41, and a part of gun 103. Initially, the lubricator L is isolated from the wellbore. Assuming for the sake of illustration that gun 103 is the first to be inserted in the string with the running tool 101, the procedure follows the following detailed steps. The running tool 101 is latched into the connector C, which is mounted to the top of gun 103. Gun 103 advances until an upset 105 hits a no-go shoulder 107. The drawing reflects the two positions of the upset 105 with the upper position illustrated by the reference numeral 105 and the lower position by the reference numeral 105'. When the running tool 101 advances gun 103 to the point where upset 105' is bottomed on the no-go shoulder 107, the recess surface 109 is in position opposite seal ram 53. At the same time, the dogs 64 in the running tool 101 are oriented such that they are in line through the window 78 for release by the actuating ram 88. Accordingly, the first gun 103 is run-in with the running tool 101 until the running tool 101 bottoms on no-go shoulder 107, at which point the seal ram 53 holds gun 103 while operation of actuating ram 88 allows the running tool 101 to disengage from gun 103 for removal from the lubricator. At this time, the next gun 41 is picked up outside the lubricator by the running tool 101 by the same latching technique previously described and illustrated in FIG. 3. At this point in time, the lower end of gun 41 also has a connector C, which has its own set of latching dogs. The portions of the connector are made up by set down weight on the running tool 101 which allows the dogs 64 of gun 41 to latch into the mating portion of the connector C, which is already secured to gun 103. The surface personnel then pick-up on running tool 101 to see if resistance is encountered. If resistance is encountered, it is a signal that the latching of gun 41 into gun 103 has occurred. It should be noted that the testing of the latched connection between guns 41 and 103 occurs while 103 is supported by the seal ram 53. Thereafter, pressure is equalized on both sides of seal ram 53 by bringing the pressure above it to the wellbore pressure which is below it. The pressure above the seal ram 53 is retained by the stripper rams 111 and 113, which are closed over the running tool 101. With the seal ram 53 released after equalization, the running tool is forced through the stripper rams 111 and 113 until the upset 105 reaches the position indicated by 105' at which time the seal ram 53 is actuated on gun 41. Additionally, seal ram 52 can be actuated on gun 103.

The process is then repeated to add gun 40 and ultimately gun 10. Depending on the length of the guns and the height of the derrick, the guns can be installed or removed individually, or more than one at a time. However, in order to remove more than one gun at a time, the actuating ram assembly 88 will also need to be disposed adjacent seal ram 52 to facilitate disconnection at a point where more than one gun can be removed, for example.

The removal process is the reverse of the insertion process, except that the upset 105 lands on stripper ram 113 to indicate proper juxtaposition of a set of dogs 64 opposite the actuating ram 88. Thus, in the configuration actually shown in FIG. 4, the seal ram 53 would be closed around the recess 43 and the annular space around gun 10 would be vented. With the sealing integrity of ram 53 determined, ram 88 is actuated to release gun 10 from gun 40. With the stripper rams 111 and 113 now in the open position, the upset 105 can clear past them to take out gun 10. While this process is going on for a back-up seal, ram 52 is maintained in the closed position. It should be noted that the no-go shoulder 107 can be made of a separate piece which is releasably secured within the lubricator such that if an emergency situation arises and all the guns need to be brought down below to shear ram 62 in a hurry, the no-go shoulder 107 will not prevent the entire assembly, along with the running tool 101 from being advanced downhole quickly below shear ram 62 for an emergency shutdown.

If for any reason any of the set of dogs 64 fail to release when the actuating ram 88 is operating, the running tool 101 can be rotated to undo thread 115 so that the running tool can be released from the particular gun in question and then a fishing tool may be sequentially inserted to grab a hold of the connector C to pull out the gun which fails to release by release of the dogs 64.

It should be noted that the seal rams 52 and 53 can fully support the weight of the entire string and that these two rams back each other up.

Accordingly, with the layout shown in FIG. 4*a*–4*c* and the process as described, the guns can be run into a live well in a string and can be removed from a live well by reversing the illustrated procedure.

The advantages of the invention are most needed when the gun string exceeds the length of the lubricator. Guns are normally about 14 feet long and derrick height limitations may require piecemeal assembly of guns even if the overall gun string is shorter than the lubricator. The invention can facilitate assembly of the gun string even if its total length is shorter than the lubricator since in that event the ram is not operated until the entire gun string is fully assembled. Even in that case, the dog method of attachment speeds assembly.

The foregoing disclosure and description of the invention are illustrative and explanatory thereof, and various changes in the size, shape and materials, as well as in the details of the illustrated construction, may be made without departing from the spirit of the invention.

We claim:

1. An assembly for connecting perforating guns and running them into and out of a live well comprising:

a lubricator mounted to a well;

at least a first gun and a second gun;

at least one connector comprising a first and second body members with said first body member mounted to said first gun and said second body member mounted to said second gun;

said body members engageable to each other to secure said guns together within said lubricator without applied rotation.

2. The assembly of claim 1 wherein:

said second body member comprises a movable piston sealed around its periphery, said movable piston actuable from said first body member to fire said second gun.

3. The assembly of claim 2 wherein:

said connector having an external recess around a zone in said connector which does not house any explosives;

said lubricator comprising at least one seal ram and at least one shear ram;

said recess selectively engageable by said seal ram for support of said guns or alternatively by said shear ram to facilitate an emergency shutdown of the well.

4. The assembly of claim 3 wherein:

at least a first and second connectors connecting a plurality of said guns;

said guns and said rams configured in a manner that when one of said connectors aligns with said seal ram another is in alignment with said shear ram.

5. The assembly of claim 4 wherein:

at least two seal rams spaced in said lubricator to allow at least two connectors to be gripped on their respective external recesses to provide backup external sealing around said guns.

6. The assembly of claim 4 wherein:

each said connector between said guns facilitates sequential firing of said guns from top to bottom as the firing of one gun triggers explosives in a connector at its lower end to fire a subsequent gun while said movable pistons due to said sealing continue to prevent internal fluid communication through said guns.

7. The assembly of claim 3 wherein:

said first body member further comprises:

at least one dog;

said second body member comprises at least one receptacle;

said dog engaging said receptacle with set down weight applied to said first gun.

8. The assembly of claim 7 wherein:

said dog further comprises a projection;

said second body member comprises a window;

said projection aligned with said window when said dog engages said receptacle.

9. The assembly of claim 8 comprising:

said dog is biased outwardly after said bias is temporarily overcome to facilitate insertion of said dog in said receptacle.

10. The assembly of claim 9 wherein:

said lubricator further comprises an actuating ram;

said window aligns with said actuating ram when said first and second body members are engaged and said second body member is supported by said seal ram in said external recess;

whereupon said first and second body members can be separated from each other as said bias on said dog is overcome by a force on said projection through said window.

11. The assembly of claim 10 wherein:

said connector can be separated if said dog does not allow release when pushed through said window by applying a twist force to unthread a joint in said connector.

12. The assembly of claim 11 wherein:

said first body member comprises a plurality of dogs disposed about a longitudinal axis of said first body member, each said dog engageable into said receptacle and each having a projection extendable into a respective window when said dog engages said receptacle.

13. The assembly of claim 12 wherein:

said second body member comprises an elongated housing holding said piston, said housing insertable in a longitudinal opening formed by said dogs;

said elongated housing when inserted into said longitudinal opening having an end disposed adjacent an explosive charge in said first body member.

14. The assembly of claim 13 wherein:

said elongated housing having a passage therein said piston movably and sealingly mounted in said passage;

whereupon setting off said charge in said first body member an end of said elongated housing is exposed to charge generated pressure to drive said piston to fire said second gun.

15. A method of insertion and removal of perforating guns through a series of rams into a pressurized wellbore through a lubricator comprising:

supporting at least a first gun in said lubricator;

mounting at least a second gun to said first gun;

using at least one connection between said guns that allows for an internal seal between said guns after said guns are fired, as well as facilitating the firing of said guns.

16. The method of claim 15 wherein:

making up said connection without applied rotation.

17. The method of claim 15 wherein:

releasing said connection without applied rotation.

18. The method of claim 15 wherein:

configuring at least one said connection to present an area of no explosives to a shear ram when a seal ram engages another connection.

19. The method of claim 15 wherein:

using set down weight on said first gun for making said connection by pushing a dog into a receptacle.

20. The method of claim 19 wherein:

using an actuating ram to push said dog out of said receptacle against a bias force for disengagement of said connection.

21. The method of claim 20 wherein:

using a twist force to break said connection if pushing on said dogs does not effect a release.

22. The method of claim 21 wherein:

using a seal ram to seal around a recessed portion of said connection which supports at least one gun;

ascertaining the well is sealed off internally and externally of at least one gun;

breaking said connection to remove another gun from the lubricator while said seal ram and at least one movable piston hold well pressure.

23. The method of claim 15 wherein:

using a movable piston sealed around its periphery in said connection to fire said second gun from said first gun.

24. The method of claim 23 wherein:

using a force created by said first gun to actuate said piston to fire said second gun.

25. The method of claim 24 wherein:

using at least one latching dog to releasably secure said connection without rotation.

26. The method of claim 23 wherein:

facilitating removal of said guns by sealing around at least one said connection with a seal ram;

using said sealed movably mounted piston to seal off the interior of a gun which is externally sealed by said seal ram while the gun above with another portion of said connection is disengaged.

27. The method of claim 26 wherein:

providing an external recess on all of said connections for selective engagement by a seal ram;

disposing no explosives in each said connection in opposite said external recess;

spacing a seal and shear ram such that when said seal ram grabs a recess on one connection, a recess on another connection is aligned with said shear ram;

using said shear ram to cut through said external recess.

28. The method of claim 27 wherein:

using a plurality of said connections to selectively connect a plurality of guns;

providing at least two seal rams;

using one of said seal rams as a backup to seal around one of said guns if another gun above cannot be effectively externally sealed using another seal ram.

29. A connector for connecting a first and a second perforating gun in a well, said connector comprising a first and a second body member, with said first body member mountable to said first gun and said second body member mountable to said second gun, wherein:

said body members are fully engageable to each other to secure said guns together solely by bringing said body members together without applied rotation.

30. A connector for connecting a first and a second perforating gun in a well, said connector comprising a first and a second body member, with said first body member mountable to said first gun and said second body member mountable to said second gun, wherein:

said body members are engageable to each other to secure said guns together without applied rotation;

the second body member comprises a movable piston sealed around its periphery, said movable piston actuable from said first body member to fire the second gun.

31. The connector of claim 30, wherein said first body member further comprises:

at least one dog;

said second body member comprises at least one receptacle;

said dog engaging said receptacle with setdown weight applied to said first gun.

32. The assembly of claim 31, wherein:

said dog further comprises a projection;

said second body member comprises a window;

said projection aligned with said window when said dog engages said receptacle.

33. The assembly of claim 32, wherein:

said dog is biased outwardly after said bias is temporarily overcome to facilitate insertion of said dog in said receptacle.

34. The assembly of claim 33, wherein:

said connector can be separated if said dog does not allow release when pushed through said window by applying a twist force to unthread a joint in said connector.

35. The assembly of claim 34, wherein:

said first body member comprises a plurality of dogs disposed along a longitudinal axis of said first body member, each said dog engageable into said receptacle and each having a projection extendable into a respective window when said dog engages said receptacle.

36. The assembly of claim 35, wherein:

said second body member comprises an elongated housing holding said piston, said housing insertable in a longitudinal opening formed by said dogs;

said elongated housing, when inserted into said longitudinal opening, having an end disposed adjacent an explosive charge in said first body member.

37. The assembly of claim 36, wherein:

said elongated housing having a passage therein;

said piston movably and sealingly mounted in said passage;

whereupon setting off said charge in said first body member, an end of said elongated housing is exposed to charge generated pressure to drive said piston to fire said second gun.

38. A downhole connector for connecting a first and second component in a well, said connector comprising:

a first and a second body member, with said first body member mountable to the first component, and said second body member mountable to the second component;

wherein said body members are engageable to each other to secure the components together without applied rotation; and said first body member further comprises:

at least one dog;

said second body member comprises at least one receptacle;

said dog engaging said receptacle with set down weight applied to said body members;

said dog further comprises a projection;

said second body member comprises an opening;

said projection aligned with said opening when said dog engages said receptacle to allow separation of said first and second body members by a force on said projection applied through said opening.

39. The connector of claim 38, wherein:

said dog is biased outwardly after said bias is temporarily overcome to facilitate insertion of said dog in said receptacle.

40. The connector of claim 39, wherein:

said connector can be separated if said dog does not allow release when pushed through said window by applying a twist force to unthread a joint in one of said first and second body members.

41. The connector of claim 40, wherein:

said first body member comprises a plurality of dogs disposed about a longitudinal axis of said first body member, each said dog engageable into said receptacle and each having a projection extendable into a respective opening when said dog engages said receptacle.

42. A method of connecting at least a first and second perforating guns for well deployment, comprising:

using a connector to connect the guns;

providing a passage through said connector;

providing an internal seal between the guns in said connector to prevent flow through said passage;

using said connector to transmit a signal from said first gun to said second gun to fire said second gun; and maintaining the integrity of said internal seal between said guns after firing said second gun.

43. The method of claim 42, further comprising:

making up said connection without applied rotation.

44. A method of connecting at least a first and second perforating guns for well deployment, comprising:

using a connector to connect the guns;

providing an internal seal between the guns in said connector;

using said connector to transmit a signal from said first gun to said second gun to fire said second gun; and using set down weight on said first gun for making said connection by pushing a dog into a receptacle.

45. A method of connecting at least a first and second perforating guns for well deployment, comprising:

using a connector to connect the guns;

providing an internal seal between the guns in said connector;

using said connector to transmit a signal from said first gun to said second gun to fire said second gun; and using a movable piston sealed around its periphery in said connection to fire said second gun from said first gun.

46. The method of claim 45, further comprising:

using a force created by said first gun to actuate said piston to fire said second gun.

47. The method of claim 46, further comprising:

using at least one latching dog to releasably secure said connection without rotation.

* * * * *